US006070027A

United States Patent [19]

Kawai et al.

[11] Patent Number: 6,070,027

[45] Date of Patent: May 30, 2000

[54] DEVELOPING APPARATUS WITH AUXILIARY SEAL DISPOSED OUTSIDE OF END SEAL

[75] Inventors: Tachio Kawai, Odawara; Susumu Nittani, Shizuoka-ken, both of Japan

[73] Assignee: Canon Kabushiki Kaisha, Tokyo, Japan

[21] Appl. No.: 09/197,427

[22] Filed: Nov. 23, 1998

[30] Foreign Application Priority Data

Dec. 2, 1997 [JP] Japan ..... 9-331570

[51] Int. Cl.[7] ..... G03G 15/08

[52] U.S. Cl. ..... 399/103; 399/105; 399/106

[58] Field of Search ..... 399/103, 105, 399/106

[56] References Cited

U.S. PATENT DOCUMENTS 5,321,473 6/1994 Azami ..... 399/103

5,758,230 5/1998 Nakaue et al. ..... 399/103

FOREIGN PATENT DOCUMENTS 7-219343 8/1995 Japan .

*Primary Examiner*—Arthur T. Grimley
*Assistant Examiner*—William A. Noē
*Attorney, Agent, or Firm*—Fitzpatrick, Cella, Harper & Scinto

[57] ABSTRACT

A developing apparatus including a developing frame, a developing roller disposed at an opening portion of the developing frame and adapted for bearing a developing agent, a first seal member for closing a gap between the developing frame and the developing roller along an entire length of the gap in a circumferential direction of the developing roller to prevent leakage of developing agent, and a second seal member contacted with outer end face of the first seal member, wherein the second seal member is only provided downstream of a developing zone at which electrostatic latent images are developed, with respect to a rotational direction of said developing roller.

15 Claims, 7 Drawing Sheets

DEVELOPING APPARATUS WITH AUXILIARY SEAL DISPOSED OUTSIDE OF END SEAL

BACKGROUND OF THE INVENTION

1. Field of the Invention

The present invention relates to a developing apparatus used in an image forming apparatus of electrophotographic type or electrostatic type such as a copying machine, a printer and is the like and adapted to develop an electrostatic latent image formed on an image bearing member.

2. Related Background Art

In image forming apparatuses using an electrophotographic process such as printers, a photosensitive drum (image bearing member) is uniformly charged, a latent image is formed on the photosensitive drum by selective exposure to the photosensitive drum, the latent image is visualized by toner (developing agent) as a toner image, and the toner image is transferred onto a recording medium. By applying heat and pressure to the transferred toner image, the toner image is fixed to the recording medium. In this way, image recording is effected.

In such image forming apparatuses, toner replenishment and maintenance of various process means are required. In order to facilitate the toner replenishment and the maintenance, there has been proposed a process cartridge in which the photosensitive drum, a charge means, a developing means and a cleaning means are collectively housed in a cartridge frame.

In such an apparatus, a developing apparatus for visualizing the latent image comprises a developing roller as a means for supplying toner stored in a developing frame to the photosensitive drum, a developing blade for regulating an amount of toner supplied to the developing roller, seal members (made of felt or the like) for preventing leakage of toner toward a longitudinal direction of the developing roller at both ends of an opening of the developing frame, and a sheet member for preventing the toner from escaping through gaps created between a lower part of the developing roller and the opening and the seal members at a lower part of the opening of the developing frame.

The sheet member is attached to the lower part of the opening of the developing frame, and one of width-wise ends is a free end. And, a part of the free end abuts against a peripheral surface of the developing roller along its entire longitudinal (axial direction of the developing roller) area.

On the other hand, longitudinal portions of the sheet member extend to positions where the sheet member overlaps with the seal members, thereby preventing the toner from escaping through the gaps.

FIG. 9 shows an example of a developing apparatus having such end seal members.

Seal members 105 are disposed between a developing roller 102 and a developing frame 101 at both longitudinal sides of a developing blade 103. The seal members 105 are generally made of flexible material formed from felt with fibers and are secured to the developing frame 101.

In order to maintain sealing ability between the seal members 105 and the developing frame 101, end faces 105*a* of the seal members 105 near a sheet member 106 are urged against a longitudinal rib 101*a* of the developing frame 101 to which the sheet member 106 is adhered.

However, particularly when the developing roller 102 has a small diameter, it is difficult to closely abut the end faces 105*a* of the seal members 105 against the longitudinal rib 101*a* of the developing frame 101, and, thus, a special technique is required for attaching the seal members 105.

SUMMARY OF THE INVENTION

An object of the present invention is to provide a developing apparatus which can prevent a developing agent from leaking through end portions.

Another object of the present invention is to provide a developing apparatus in which seal members are assembled.

A further object of the present invention is to provide a developing apparatus comprising a developing frame, a developing roller provided at an opening portion of the developing frame, a first seal member for closing a gap between the developing frame and the developing roller to prevent leakage of a developing agent, and a second seal member provided to contact with an outer end face of the first seal member.

The other objects and features of the present invention will be apparent from the following detailed explanation referring to the accompanying drawings.

DESCRIPTION OF THE PREFERRED EMBODIMENTS

The present invention will now be explained in connection with embodiments thereof with reference to the accompanying drawings.

Figure 1:
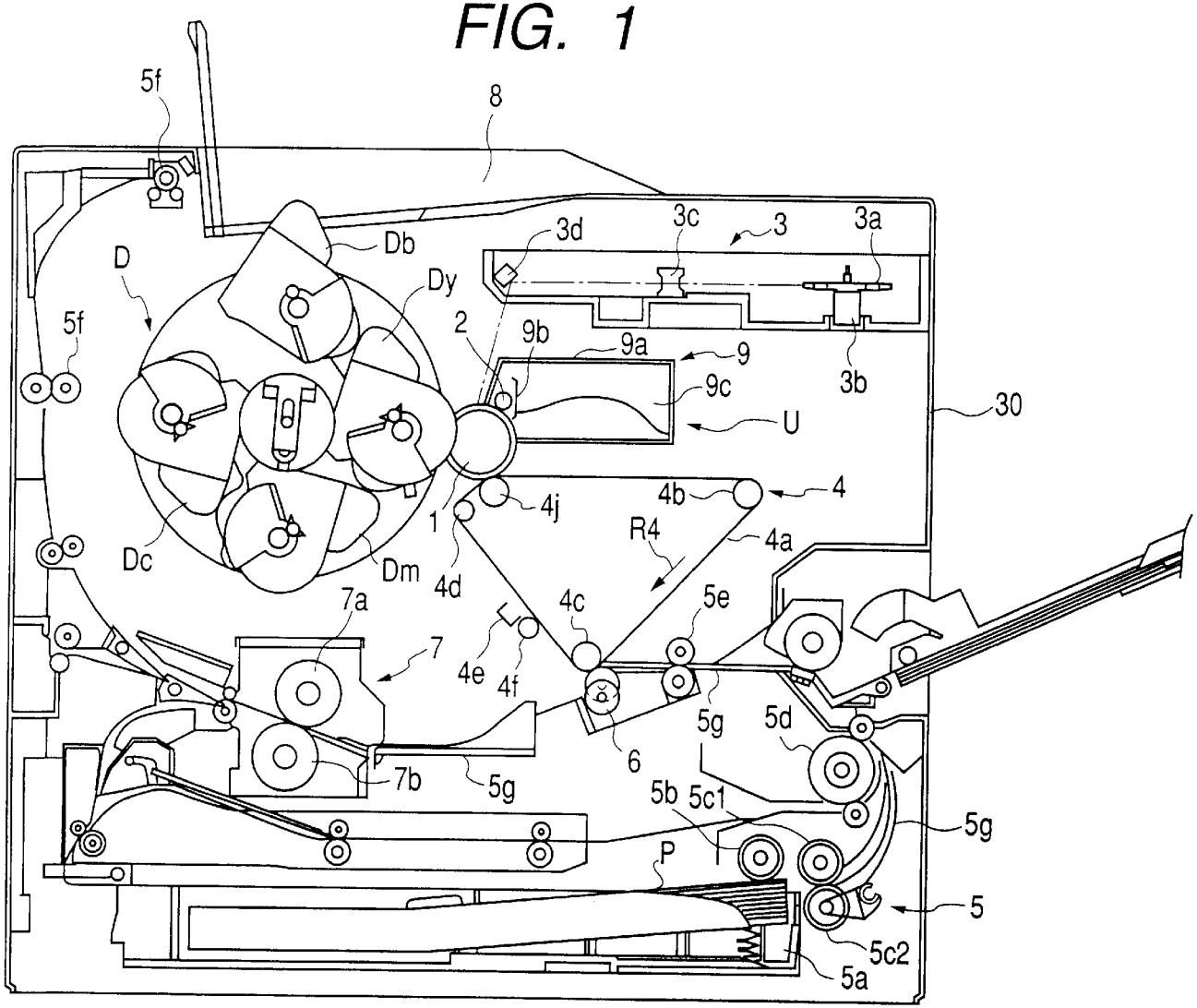
FIG. 1 is a sectional view of a laser beam printer (image forming apparatus) using a developing apparatus according to a preferred embodiment of the present invention.

FIG. 1 is a sectional view of a laser beam printer (image forming apparatus) for forming a color image by using an electrophotographic system. In the laser beam printer, a surface of a drum-shaped electrophotographic photosensitive member (referred to as "photosensitive drum" hereinafter) 1 rotated at a constant speed is uniformly charged. When a laser beam corresponding to image information from an exposure means 3 is illuminated onto the photosensitive drum 1, a latent image is formed on the photosensitive drum 1, and the latent image is developed by four developing cartridges D (Dy, Dm, Dc and Db).

Developed image successively formed on the photosensitive drum 1 are successively transferred onto a belt-shaped intermediate transfer body 4 in a superimposed fashion, thereby forming a full-color image. The full-color image is transferred, by a transfer means 6, onto a recording medium P (for example, recording sheet, OHP sheet or the like) conveyed from a sheet supply portion by a convey means 5. Then, the recording medium P is conveyed to a fixing means 7, where the color image is fixed to the recording medium. Thereafter, the recording medium is discharged onto a discharge portion 8 provided on an upper surface of the printer.

Next, various elements are fully described.

The photosensitive drum 1, the charge means 2 and a cleaning means 9 are formed as a process cartridge U which can detachably be mounted to a body 30 of the image forming apparatus. If the service life of the photosensitive drum 1 is expired, the process cartridge U can be exchanged for a new one by an operator himself. Incidentally, the cleaning means 9 serves to remove residual toner remaining on the photosensitive drum 1 after the developing agent (referred to as "toner" hereinafter) images (toner images) were transferred to the intermediate transfer body 4.

The photosensitive drum 1 is constituted by an aluminium cylinder having a diameter of 50 mm, and an organic photo-conductive layer coated on the cylinder and is rotatably supported by a container-shaped frame 9*a* (also acting as a holder) of the cleaning means 9. Around the photosensitive drum 1, there are disposed a cleaning blade 9*b* for scraping the residual toner on the photosensitive drum 1, and the charge means 2.

During image formation, the photosensitive drum 1 is rotated in an counterclockwise direction in FIG. 1 by a drive motor (not shown).

The charge means 2 is of a so-called contact charging type and serves to uniformly charge the surface of the photosensitive drum 1 by applying voltage to a conductive roller contacted with the surface of the photosensitive drum 1.

In the exposure means 3 for effecting the exposure to the charged photosensitive drum 1, when an image signal is given to a laser diode (not shown), image light emitted from the laser diode and corresponding to the image signal is illuminated onto a polygon mirror 3*a*. The polygon mirror 3*a* is rotated at a high speed by a scanner motor 3*b*, and the image light reflected by the polygon mirror 3*a* selectively exposes the surface of the photosensitive drum 1 (rotated at the constant speed) through a focusing lens 3*c* and a reflection mirror 3*d*, thereby forming an electrostatic latent image on the photosensitive drum 1. The electrostatic latent images successively formed on the photosensitive drum are developed by the developing cartridges (developing devices) D as respective color toner images which are in turn transferred onto the intermediate transfer body 4 successively.

The intermediate transfer body (second image bearing member) 4 serves to secondary-transfer the plurality of toner images (successively first-transferred from the photosensitive drum 1 in a superimposed fashion) onto the recording medium P collectively and has an intermediate transfer belt 4*a* rotated in a direction shown by the arrow R4. The intermediate transfer belt 4*a* has a peripheral length of about 440 mm and is wound around a drive roller 4*b*, a secondary transfer counter roller 4*c* and a driven roller 4*d*.

In the vicinity of the driven roller 4*d*, there is provided a press roller 4*j* for urging the intermediate transfer belt 4*a* against the photosensitive drum 1, and the press roller 4*j* can be retracted to a position where the intermediate transfer belt 4*a* is separated from the photosensitive drum 1.

The intermediate transfer belt 4*a* is shifted in the direction R4 by rotation of the drive roller 4*b*. A cleaning unit 4*e* capable of being engaged by and disengaged from the surface of the intermediate transfer belt 4*a* is disposed at a predetermined position outside of the intermediate transfer belt 4*a* so that transfer residual toner remaining on the intermediate transfer belt after the secondary-transferring can be removed by the cleaning unit 4*e*. The cleaning unit 4*e* serves to urge a charge roller 4*f* against the intermediate transfer belt 4*a* to impart a charge to the toner opposite to a polarity of the toner on the transfer belt. The oppositely charged toner is electrostatically adhered to the photosensitive drum 1, and the toner adhered to the photosensitive drum 1 is collected by the cleaning means 9. Incidentally, a method for cleaning the intermediate transfer belt 4*a* is not limited to the above-mentioned electrostatic cleaning, but, a mechanical method using a blade or a fur brush or a combination of the electrostatic cleaning and the mechanical cleaning may be used.

As mentioned above, the toner remaining on the photosensitive drum 1 after the toner image was transferred to the intermediate transfer body 4 is removed by the cleaning means 9. In the cleaning means 9, the toner is scraped by a cleaning blade 9*b* contacted with the surface of the photosensitive drum 1 and the scraped toner is collected into a waste toner container 9*c*. The waste toner container 9*c* is formed from a cleaning frame 9*a*, and a capacity or volume of the waste toner container 9*c* is selected so that the waste toner container 9*c* in not filled with the toner before the service life of the photosensitive drum 1 is expired. Incidentally, after the service life of the photosensitive drum 1 is expired, when the process cartridge U is exchanged, the waste toner in the waste toner container 9*c* is treated.

In the illustrated embodiment, the transfer means 6 for transferring the toner images transferred to the intermediate transfer body 4 in the superimposed fashion onto the recording medium P comprises a transfer roller which is constituted by a metal shaft and an intermediate resistance foam elastic body wound around the metal shaft and can be shifted in an up-and-down direction in FIG. 1. While four color toner images are being formed on the intermediate transfer body 4 (i.e., while the intermediate transfer body 4 is being rotated by plural times), the transfer roller 6 is located at a lower position to be spaced apart from the intermediate transfer body 4 (as shown by the solid line in FIG. 1), thereby preventing distortion of the images.

After the toner images were transferred to the intermediate transfer body 4 to form the full-color image, the transfer roller 6 is shifted to an upper position (shown by the dot and chain line in FIG. 1) by means of a cam (not shown) in synchrony with a timing for transferring the color image onto the recording material P. As a result, the transfer roller 6 is urged against the intermediate transfer body 4 with predetermined pressure with the interposition of the recording medium P. At the same time, bias voltage is applied to the transfer roller 6, thereby transferring the toner images on the intermediate transfer body 4 onto the recording medium P.

On the other hand, as shown in FIG. 1, the convey means 5 for conveying the recording medium P comprises a sheet supply cassette 5*a* for containing a plurality of recording media P, a pick-up roller 5*b*, a sheet feed roller 5*c*1 and a double-feed preventing retard roller 5*c*2, a pair of convey rollers 5*d*, a pair of regist rollers 5*e*, a pair of discharge rollers 5*f*, and a convey guide 5*g*.

During the image formation, the pick-up roller 5*b* is rotated in synchrony with the image forming operation to separate and supply the recording media P in the sheet supply cassette 5*a* one by one. The recording medium P fed from the sheet supply cassette 5*a* is guided by the convey guide 5*g* to bring the recording medium P to the pair of regist rollers 5*e* through the pair of convey rollers 5*d*. During the image forming operation, the regist roller pair 5*e* performs a non-rotating operation for stopping and waiting the recording medium P and a rotating operation for conveying the recording medium P toward the intermediate transfer body 4 at a predetermined sequence, thereby effecting registration between the color image and the recording medium P in the next transferring process. Then, the color image is transferred onto the recording medium P by the transfer roller 6.

The recording medium P to which the color image was transferred is conveyed to the fixing means 7, where the color image is fixed to the recording medium. The fixing means 7 comprises a fixing roller 7*a* for applying heat to the recording medium P, and a pressure roller 7*b* for urging the recording medium P against the fixing roller 7*a*. These rollers 7*a* and 7*b* are hollow rollers including heaters therein and are rotated at predetermined speeds. By conveying the recording medium P while applying heat and pressure, the color toner images are fixed to the recording medium P.

The recording medium P to which the full-color image was fixed is discharged onto a discharge portion 8 by means of the pair of discharge rollers 5*f* forming a part of the convey means.

Figure 2:
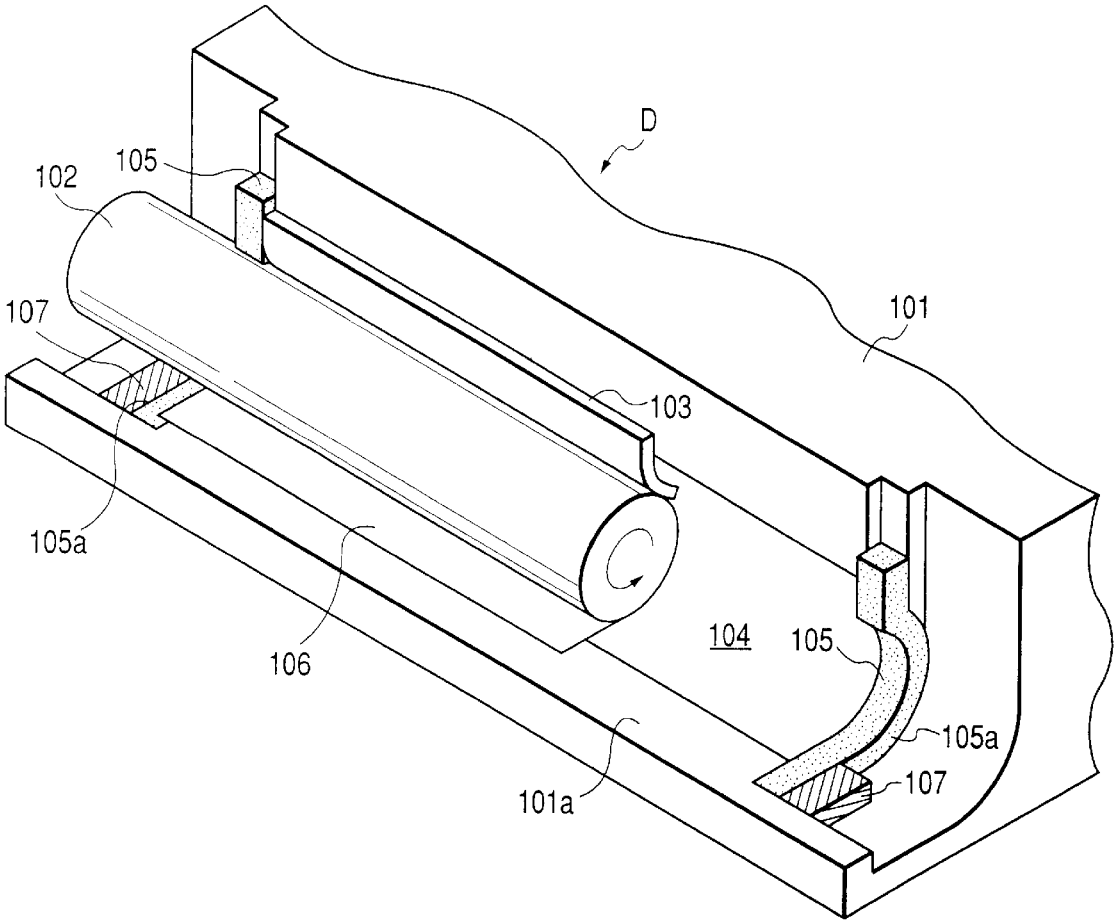
FIG. 2 is a perspective view showing a main part of a developing apparatus according to a first embodiment of the present invention.

Next, the developing apparatus D according to the present invention will be explained with reference to FIG. 2. Incidentally, FIG. 2 is a perspective view showing a main part of the developing apparatus according to the present invention.

The developing apparatus D has a developing frame 101 constituting a developing container for containing a one-component, nonmagnetic toner.

The developing frame 101 has an opening portion 104 opposed to the photosensitive drum 1. At the opening portion 104, there are provided a developing roller 102 adapted to bear the toner and rotated in a direction shown by the arrow in FIG. 2, a developing blade 103 for regulating a thickness of a toner layer on the developing roller 102, seal members 105 (made of elastic felt) disposed at both axial ends of the developing roller 102 and adapted to close a gap between the developing frame 101 and the developing roller along the entire periphery of the developing roller 102 to prevent the toner from leaking through the ends of the developing roller, and a sheet member 106 (formed from a resin sheet) disposed to permit collection of the toner after development and to prevent the internal toner from escaping.

Incidentally, in order to clearly show a construction of one of the seal members 105, parts of the developing roller 102, developing blade 103 and sheet member 106 are omitted from the illustration.

Auxiliary seal members 107 made of elastic material such as moltprene are disposed outside of the seal members 105.

The auxiliary seal members 107 are provided only at a toner collecting side of the opening portion 104.

The reason is that end portions of the sheet member 106 are urged by the seal members 105 to create small gap due to a thickness of the sheet member 106 to facilitate leakage of toner.

The areas in the circumferential direction of the developing roller 102 where the sheet member 106 does not exist are adequately sealed by the seal members 105.

In the illustrated embodiment, the auxiliary seal members 107 are arranged to closely contact with end faces 105*a* of the seal members 105 and the developing frame 101, thereby preventing the toner passing through the gaps from leaking outside. As a result, sealing ability of the seal members 105 is improved, and the attaching accuracy of the auxiliary seal members 107 is relieved to enhance the assembling ability of the seal members 105.

Second Embodiment

Figure 3:
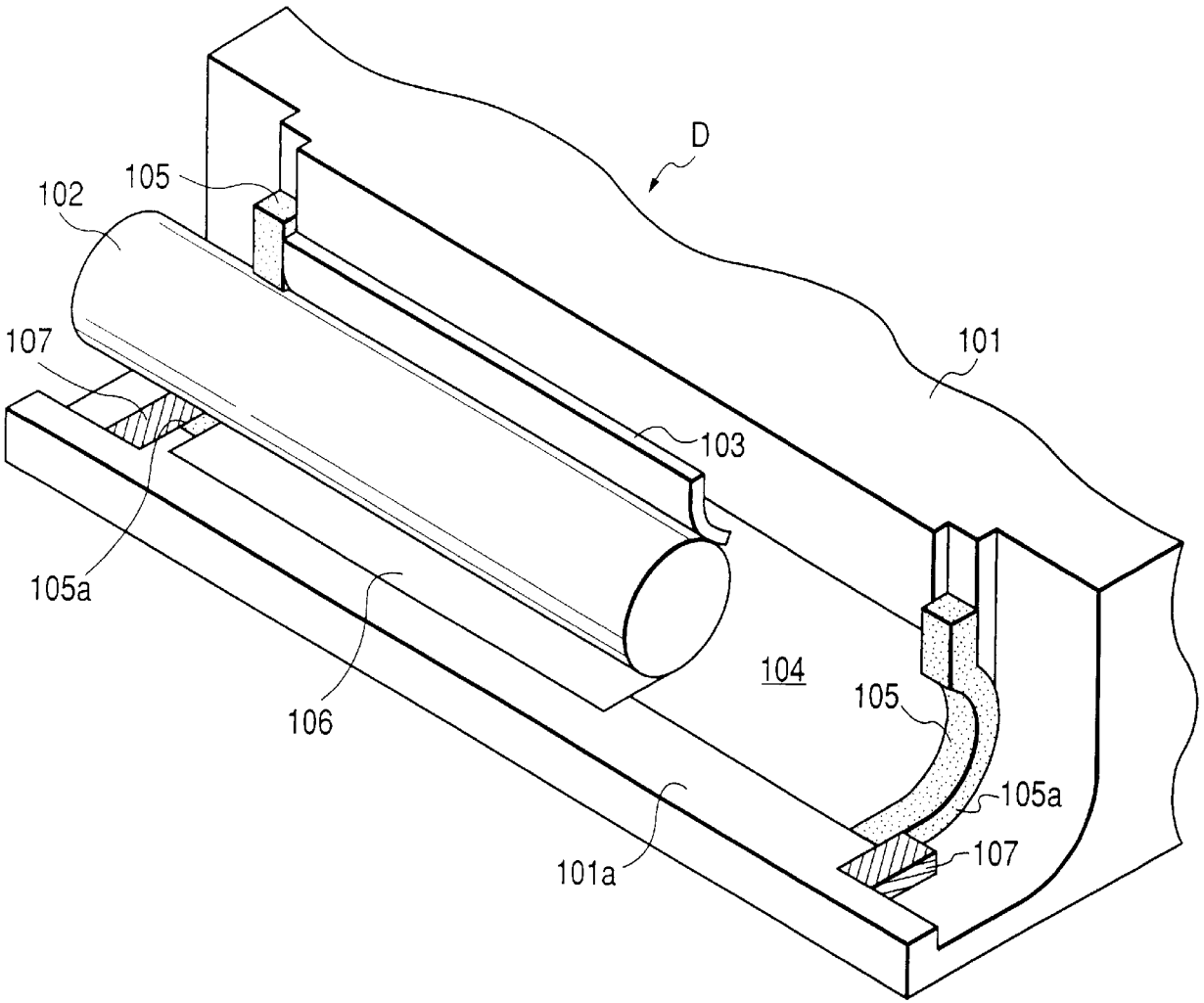
FIG. 3 is a perspective view showing a main part of a developing apparatus according to a second embodiment of the present invention.

Next, a second embodiment of the present invention will be explained with reference to FIG. 3. Incidentally, FIG. 3 is a perspective view showing a main part of a developing apparatus according to the second embodiment of the present invention.

As is in the first embodiment, the developing apparatus D according to the second embodiment comprises a developing frame 101, a developing roller 102, a developing blade 103, seal members 105 provided at both ends of an opening portion 104 of the developing frame 101 and adapted to prevent toner from leaking through the developing roller 102 laterally, a sheet member 106 attached to a lower portion 101*a* of the opening portion 104 of the developing frame 101 to prevent the toner from escaping through gaps created between the lower portion of the developing roller 102 and the opening portion 104 and the seal members 105, and auxiliary seal members 107 adhered to outer surfaces of the seal members 105.

In this embodiment, the auxiliary seal members 107 seal gaps in the interfaces between the end faces 105*a* of the seal members 105 and the developing frame 101 and are disposed to closely contact with the seal members 105 and the developing frame 101, thereby preventing the toner from flowing out through the gaps. As a result, the sealing ability and assembling ability of the seal members 105 are enhanced.

Third Embodiment

Next, a third embodiment of the present invention will be explained with reference to FIGS. 4 to 8. Incidentally, FIG. 4 is a perspective view showing a main part of a developing apparatus according to the third embodiment of the present invention, FIG. 5 is a sectional view showing the main part of the developing apparatus according to the third embodiment in a condition before urging members are inserted, FIG. 6 is a sectional view showing the main part of the developing apparatus according to the third embodiment in a condition after the urging members are inserted, FIG. 7 is a sectional view showing the main part of the developing apparatus according to the third embodiment in a condition before urging members to which auxiliary seal members are adhered are inserted, and FIG. 8 is a sectional view showing the main part of the developing apparatus according to the third embodiment in a condition after the urging members to which the auxiliary seal members are adhered are inserted.

Figure 4:
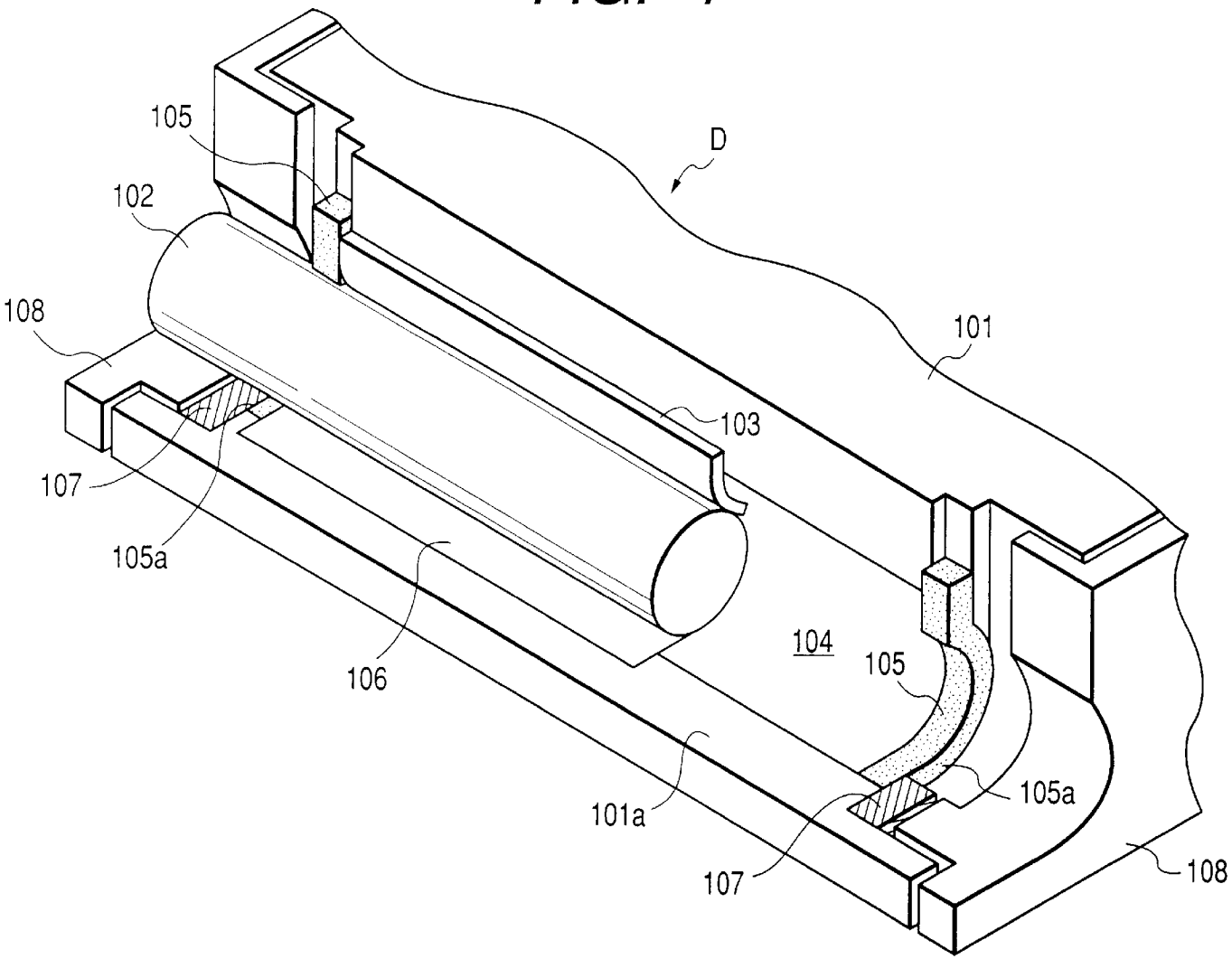
FIG. 4 is a perspective view showing a main part of a developing apparatus according to a third embodiment of the present invention.

In the third embodiment, as shown in FIG. 4, the developing device D comprises a developing frame 101, a developing roller 102, a developing blade 103, seal members 105 provided at both ends of an opening portion 104 of the developing frame 101 and adapted to prevent toner from leaking through the developing roller 102 laterally, a sheet member 106 attached to a lower portion 101*a* of the opening portion 104 of the developing frame 101 to prevent the toner from escaping through gaps created bet ween the lower portion of the developing roller 102 and the opening portion 104 and the seal members 105, auxiliary seal members 107, and urging members 108 for urging the auxiliary seal members 107 axially inwardly to secure the auxiliary seal members.

Figure 5:
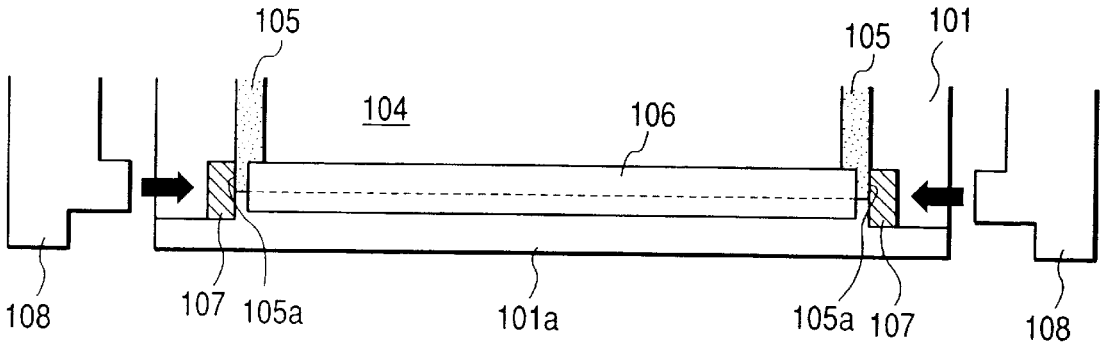
FIG. 5 is a sectional view showing the main part of the developing apparatus according to the third embodiment in a condition before urging members are inserted.
Figure 6:
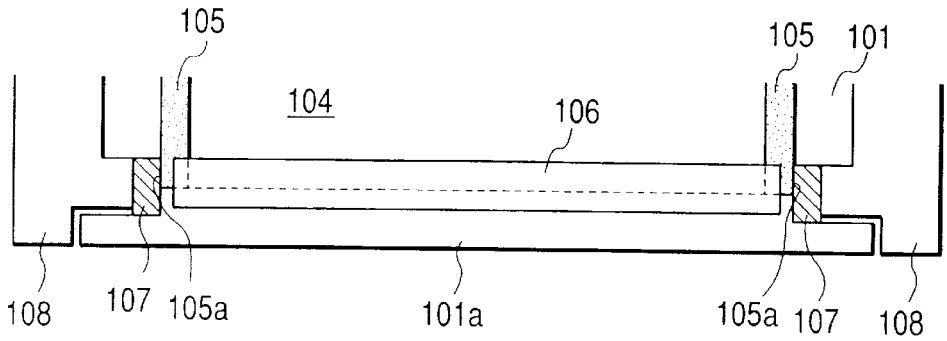
FIG. 6 is a sectional view showing the main part of the developing apparatus according to the third embodiment in a condition after the urging members are inserted.

In this embodiment, as shown in FIGS. 5 and 6, the urging members 108 are inserted into the developing frame 101 laterally. By urging the auxiliary seal members 107 arranged to seal gaps in the interfaces between the end faces 105*a* of the seal members 105 and the developing frame 101 by means of the urging members 108 toward directions shown by the arrows in FIG. 5, as shown in FIG. 6, the auxiliary seal members 107 are closely contacted with the end faces of the seal members 105, thereby preventing the toner from flowing out through the gaps.

Figure 7:
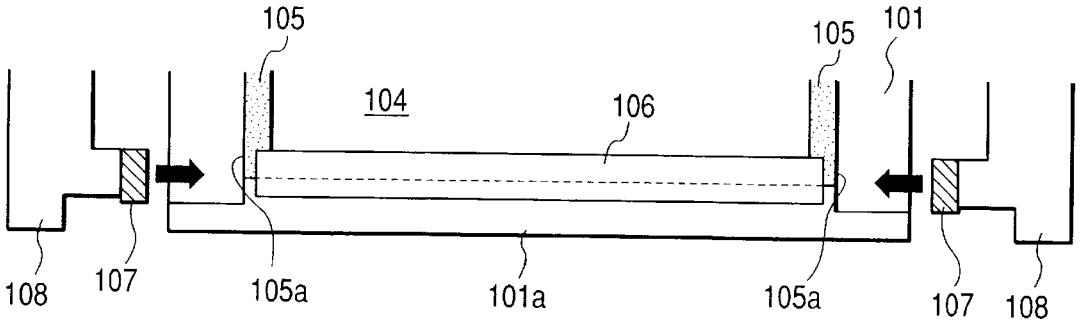
FIG. 7 is a sectional view showing the main part of the developing apparatus according to the third embodiment in a condition before urging members to which auxiliary seal members are adhered are inserted.
Figure 8:
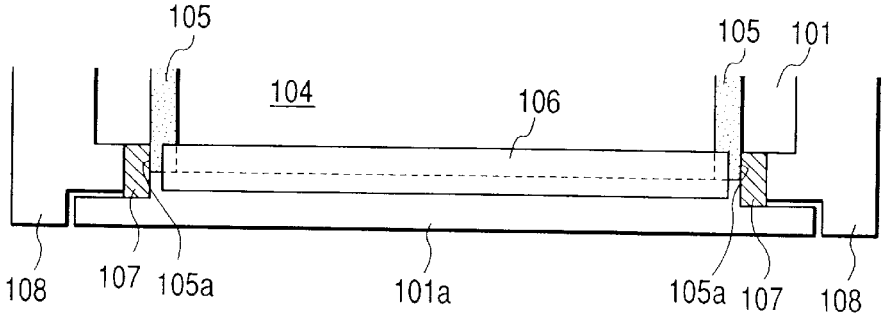
FIG. 8 is a sectional view showing the main part of the developing apparatus according to the third embodiment in a condition after the urging members to which the auxiliary seal members are adhered are inserted.
Figure 9:
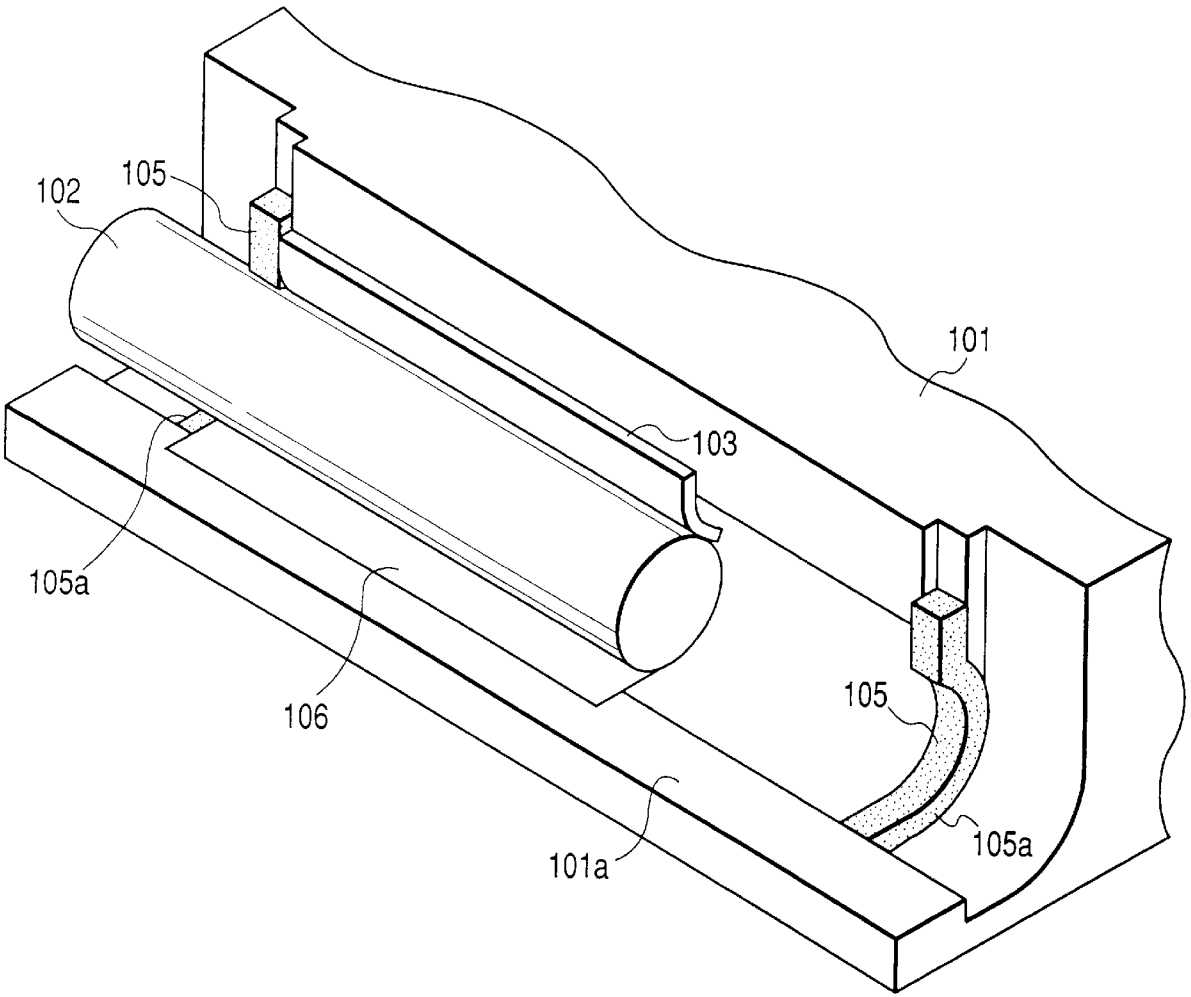
FIG. 9 is a perspective view showing a main part of a developing apparatus.

Further, in this embodiment, as shown in FIGS. 7 and 8, the auxiliary seal members 107 may be adhered to the urging members 108 and the urging members 108 may be inserted into the developing frame 101 laterally in FIG. 7 (toward directions shown by the arrows in FIG. 7) to closely contact the auxiliary seal members 107 adhered to the urging members 108 with the seal members 105 at positions where the auxiliary seal members 107 seal the gaps in the interfaces between the end faces 105*a* of the seal members 105 and the developing frame 101. Also in this arrangement, the toner can be prevented from flowing out through the gaps, and the assembling ability of the seal members 105 can be enhanced.

While the present invention was explained in connection with the embodiments thereof, the present invention is not limited to such embodiments, but various alterations can be made within the scope of the invention.

What is claimed is:

1. A developing apparatus comprising:

a developing frame;

a developing roller provided at an opening portion of said developing frame and adapted for bearing a developing agent;

a first seal member for closing a gap between said developing frame and said developing roller along an entire length of the gap in a circumferential direction of said developing roller to prevent leakage of the developing agent; and a second seal member provided to contact an outer end face of said first seal member, wherein said second seal member is only provided downstream of a developing zone at which electrostatic latent images are developed, with respect to a rotational direction of said developing roller.

2. A developing apparatus according to claim 1, wherein said second seal member extends further upstream with respect to the rotational direction of said developing roller than said first seal member.

3. A developing apparatus according to claim 1, further comprising an urging member for urging said second seal member against said first seal member.

4. A developing apparatus according to claim 1, further comprising a sheet member provided along an axial direction of said developing roller to prevent the developing agent from escaping, wherein said sheet member is overlapped with said first seal member in the axial direction of said developing roller and is spaced apart from said second seal member.

5. A developing apparatus according to claim 4, wherein said sheet member is provided at a downstream side of said developing zone.

6. A developing apparatus according to claim 1, wherein said developing agent includes one-component, nonmagnetic developing agent.

7. A developing apparatus comprising:

a developing frame;

a developing roller provided at an opening portion of said developing frame and adapted for bearing developing agent;

a first seal member for closing a gap between said developing frame and said developing roller to prevent leakage of the developing agent; and a second seal member disposed so as to contact an outer end face of said first seal member, wherein said second seal member extends further upstream with respect to a rotational direction of said developing roller than said first seal member.

8. A developing apparatus according to claim 7, further comprising an urging member for urging said second seal member against said first seal member.

9. A developing apparatus according to claim 7, further comprising a sheet member provided along an axial direction of said developing roller to prevent the developing agent from escaping, wherein said sheet member is overlapped with said first seal member in the axial direction of said developing roller and is spaced apart from said second seal member.

10. A developing apparatus according to claim 9, wherein said sheet member is provided at a downstream side of said developing zone.

11. A developing apparatus according to claim 7, wherein said developing agent comprises a one-component, nonmagnetic developing agent.

12. A developing apparatus comprising:

a developing frame;

a developing roller provided at an opening portion of said developing frame and adapted for bearing a developing agent;

a first seal member for closing a gap between said developing frame and said developing roller to prevent leakage of the developing agent;

a second seal member disposed so as to contact an outer end face of said first seal member; and an urging member for urging said second seal member against said first seal member.

13. A developing apparatus according to claim 12, further comprising a sheet member provided along an axial direction of said developing roller to prevent the developing agent from escaping, wherein said sheet member is overlapped with said first seal member in the axial direction of said developing roller and is spaced apart from said second seal member.

14. A developing apparatus according to claim 13, wherein said sheet member is provided at a downstream side of said developing zone.

15. A developing apparatus according to claim 12, wherein said developing agent comprises a one-component, nonmagnetic developing agent.

* * * * *

UNITED STATES PATENT AND TRADEMARK OFFICE

CERTIFICATE OF CORRECTION

PATENT NO. : 6,070,027

DATED : May 30, 2000

INVENTOR(S) : Tachio KAWAI et al.

It is certified that error appears in the above-identified patent and that said Letters Patent is hereby corrected as shown below:

COLUMN 1

Line 10, "is" should be deleted and "adapted" should read --is adapted--.

COLUMN 3

Line 4, "image" should read --images--; and

Line 35, "an" should read --a--.

COLUMN 4

Line 32, "in" should read --is--.

COLUMN 5

Line 65, "small gap" should read --small gaps--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*